United States Patent [19]

Crisci

[11] 4,177,930

[45] Dec. 11, 1979

[54] CLOSURE HAVING OPENING MEANS

[75] Inventor: Victor E. Crisci, Wellsburg, W. Va.

[73] Assignee: Polysar Resins, Inc., Leominster, Mass.

[21] Appl. No.: 910,527

[22] Filed: May 30, 1978

[51] Int. Cl.[2] ..... B65D 43/26

[52] U.S. Cl. ..... 220/284; 220/306

[58] Field of Search ..... 220/284, 306, 308, 266, 220/260; 215/317, 320, 321; 150/0.5

[56] References Cited

U.S. PATENT DOCUMENTS

| | | | |
|---|---|---|---|
| 3,516,571 | 6/1970 | Roper et al. | 220/308 |
| 3,811,597 | 5/1974 | Frankenberg et al. | 220/284 |

*Primary Examiner*—George T. Hall

*Attorney, Agent, or Firm*—Stevens, Davis, Miller & Mosher

[57] ABSTRACT

A container closure especially for large containers and having circumferentially spaced tool access regions in a rim flange for insertion of a removal tool. These access regions are located between a base of the flange and a locking bead. Between the access regions, sections of a discontinuous locking bead extend around the inside of the flange, the bead being discontinuous across the circumferential area occupied by the access regions to enable a removal tool to be inserted downwardly through the access regions and between bead sections. Rim stiffening protrusions project from the outer surface of the flange beneath the access regions and across the circumferential line of the locking bead to stiffen the flange to prevent it from splitting when a removal tool is inserted down through the access regions and between bead sections. Any force applied by the tool to flex the flange outwards is carried circumferentially around the flange to cause flange flexure at the bead sections and assist in unlocking the bead.

10 Claims, 9 Drawing Figures

CLOSURE HAVING OPENING MEANS

This invention relates to closures of the kind used to sealingly cover containers.

Closures for containers may be constructed to fit solely within the confines of sidewalls of the containers and various methods have been devised for closure removal. This invention is associated with the solving of a removal problem sometimes presented by closures having marginal rim flanges which fit around upper sidewall regions and lips of containers. In one basic type of construction, the closures are held onto their containers by coacting locking means which are provided by mutually opposed abutment shoulders on an inwardly directed circumferentially extending rib on the closure and an outwardly directed rib or lip on the container. To remove a closure under these circumstances, it is necessary to flex the marginal rim flange radially outwards so as to disengage the abutment shoulders thus allowing the flange and closure to be moved upwardly off the rim. With small containers, for instance of one gallon capacity, this closure removal action causes no undue difficulty and a closure formed of flexible resilient plastic material is removable without undue distortion and without being cut so as to be reuseable for covering and sealing of the same or another container. However, for containers of greater capacity, closures need to be made of thicker and stronger section to make them more rigid as they are of larger diameter and also to withstand impact loads, in the event that a filled container is dropped, without being forceably removed under the weight of the contents. The problem presented by these closures, therefore, is in providing a design which will make them sufficiently strong and rigid, particularly around the marginal rim flange, so that inadvertent or accidental removal of the closures is a virtual impossibility, but at the same time ensuring that the closures can be removed by manual effort in a not too difficult a fashion and without causing any undue strain to be placed upon any person desiring to open the containers.

This problem which becomes particularly acute with containers of up to five gallon capacity has been solved by constructions described in U.S. Pat. Nos. 3,519,163 (Bardell) and 3,770,156 (Yates). In U.S. Pat. No. 3,519,163, there is described the use of tear lines in the marginal rim flange along which the flange separates to allow for removal of the closure. Tearing of a marginal rim flange has also been disclosed elsewhere, such as in U.S. Pat. No. 3,403,812 (Weber). In U.S. Pat. No. 3,770,156, there is a disclosure of a rim flange having a plurality of spaced-apart slots spaced from a free end of the flange. This is a construction rendered sufficiently rigid to prevent closure removal by the rigidifying effect of the free end of the flange. To allow for closure removal, it is necessary to cut downwards from the slots to the free end of the flange so as to make the free end discontinuous and form pivotal tabs of the flange between slots.

The above described constructions may be referred to as "tamperproof closures" in that a cut or torn closure which has been removed and refitted to its container can immediately be identified as one which has been already removed. Such knowledge is useful to a person who may wish to know whether the container contents may have been interfered with. However, defacement of the closure for its removal makes it a virtual impossibility to provide a hundred percent efficient seal between closure and container when it is refitted. In addition, there are uses to which containers may be put in which the user is more interested in having an efficient seal when the closure is refitted than he is in being able to identify from a torn closure that the container contents have been tampered with. Such a situation may be found mainly with the larger containers in which the robust nature of the closure and its sealing fit to a container is also of importance so as to prevent forceable removal under impact loads as mentioned above.

The present invention provides a closure with a rim flange which allows for its removal without defacement such that it can be resealed upon its container but at the same time allows for a rigid construction which will successfully resist any tendency for accidental removal under impact loads in the event of the dropping of the filled container.

Accordingly, the present invention provides a closure for a container with a cover portion and a continuous rim flange extending around the cover portion in which the rim is formed with a plurality of circumferentially spaced-apart access regions for enabling a rigid prising tool to be passed through the flange, the access regions being disposed between a base end of the flange and a locking bead. The access regions are also disposed circumferentially between adjacent discontinuous sections of the locking bead. Rim stiffening protrusions are associated with the access regions and each protrusion projects from the outer surface of the flange in a circumferential position between sections of the locking bead and overlies the circumferential line of the locking bead to resist bending in the circumferential positions and in the circumferential direction so as to assist bending outwards of the flange circumferentially at each side of said access regions to promote radial outward movement of the locking bead. The positioning of the access regions in circumferential positions between adjacent sections of the locking bead, i.e. directly above gaps between the sections, allows the removal tool to exert its prising force within a gap so that this force is transmitted directly in a circumferential direction by the stiffening protrusions to the sections of locking bead. Enabling the tool to operate in this way ensures the tool is as close as possible to the ends of the sections and thus reduces the chances of flexing of the flange compared with a case in which the tool applies its prising load at a position above the locking bead. In the latter case, flexing of the flange between the point of application of the tool and the locking bead would increase the difficulty in removal of the closure. Alternatively, in a construction according to the invention where the locking bead is spaced from the free end of the flange, the prising tool could be pushed through an access region sufficiently far to cause its lower end to extend through and beyond the gap between the discontinuous bead sections. While this would increase the distance between the point of application of the tool and the ends of the bead sections, this disadvantage would be outweighed by the mechanical advantage gained by the increase in leverage distance of the tool from its fulcrum position at or adjacent the base end of the flange.

The transmission of the prising force to the discontinuous bead sections is assisted by the fact that the protrusions overlie the circumferential line of the locking bead. Also, in preferred constructions assistance is gained in this respect where each protrusion extends circumferentially at least the distance between ends of adjacent locking bead sections and in which the protrusions extend from the circumferential line of the locking bead to or towards the free end of the flange.

The invention also includes a container and closure assembly in which the container has a radially outwardly projecting bead beneath which the locking bead is lockably engaged, and the flange and the bead of the container define a space between them which lies between adjacent sections of the locking bead.

The access regions may each be a hole formed in the flange or a web of flange material which is thinner than surrounding areas of flange. This web obviously needs to be sufficiently thin to allow the closure removal tool to be forced to pierce it without difficulty. One advantage in using such webs is that upon replacement of the closure upon a container, the broken web will establish that access may have previously been made to the container contents. Thus, a tamperproof closure is provided without the sealing and locking parts of the closure suffering any detrimental treatment.

Embodiments of the invention will now be described, by way of example, with reference to the accompanying drawings in which.

Figure 1:
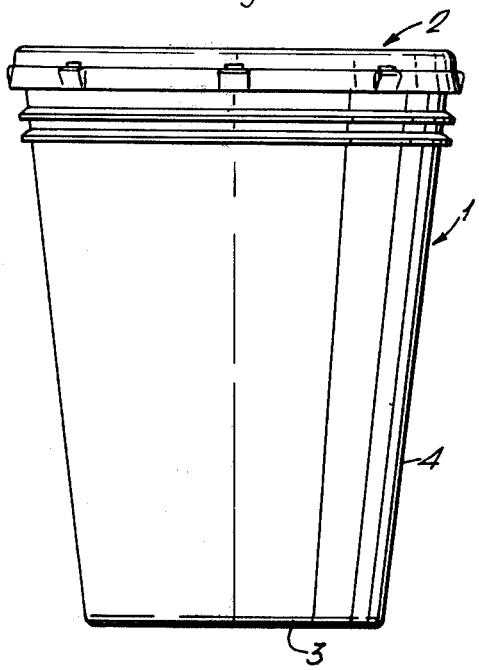
FIG. 1 is a side elevational view of a container and closure according to a first embodiment.

In a first embodiment as shown in FIG. 1, a container and closure assembly comprises a five-gallon container 1 and closure 2. Both the container and closure are injection moulded from a poly-alpha-olefin such as high density polyethylene although impact polypropylene may be used. Alternatively, other suitable materials may be used instead such as a polyvinyl halide, e.g. polyvinyl chloride or a polyvinyl aromatic, e.g. polystyrene.

The container has a base 3 and frusto-conical sidewalls 4 terminating at an open upper end in a lip 5. The lip has a radially outwardly projecting bead 6 with a lower abutment shoulder 7 for engagement with the closure as will be described.

The closure comprises a closure portion 8 around which extends a continuous and downwardly flared rim flange 9. The rim flange extends upwardly from a lower free end 10 to a base 11 which extends radially inwards and connects the flange to the closure portion in a manner to be described.

The closure comprises a discontinuous locking bead extending circumferentially around it and in the form of discontinuous sections 13 projecting inwardly from the rim flange and spaced from the free end of the flange to engage beneath the bead 6 when the closure is in position on top of the container so as to hold the closure in this position. A compressible sealing ring 14 is mounted between the lip 5 and base 11 of the closure to effect a seal.

For the purpose of enabling the closure to be removed from the container, a plurality of access regions for a removal tool are provided in spaced-apart regions around the rim flange. Each access region is a hole 16 provided for the insertion of a tool in a downward direction through the flange, the holes 16 being located in circumferential positions between the bead sections 13 and between the base 11 of the flange and the locking bead.

Figure 5:
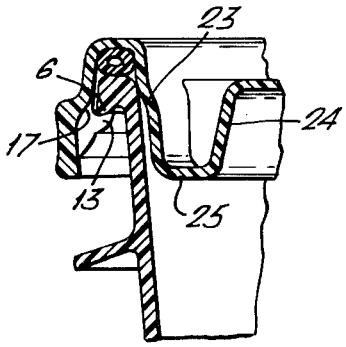

As shown in FIG. 5, the inner wall 17 of the rim flange is a plain unrelieved or shaped wall between the end of each bead section 13 and the base 11 and is of substantial thickness in section. However, to enable a removal tool to be inserted in a downward direction between the rim flange and the bead 7, the wall 17 is formed with a vertical recess 18 which is the width of hole 16, has a vertical base wall 19 and extends down to the free end 10 of the flange. Measures are taken to prevent reduction in thickness caused by recess 18 from resulting in splitting of the flange upon insertion of a removal tool. To this end, the flange is provided with rim stiffening protrusions 20 which are of rectangular shape in side elevation and extend directly one from beneath each hole 16, across the circumferential line of the locking bead, and merge into the flange near free end 10 of the flange. Each protrusion extends on each circumferential side of the hole 16 to provide the parts of the flange between the ends of the bead sections 13 and recess 18 with substantial thickness and rigidity. Each protrusion extends, in fact, as far as the ends of the bead sections 13 as shown in FIG. 6.

The flange 9 is connected by its base 11 to the closure portion 8 by means of discontinuous arcuate sections 21 of a U-shaped reinforcement 22 lying radially within the flange 9. Each section 21 has an outer leg 23 and inner leg 24 joined by a base 25 (FIGS. 4 and 5), the outer leg lying within the sidewall 4 of the container and being spaced from the sidewall except at the top of the outer leg which is of larger diameter and engages the inner surface of the sidewall towards its top. The outer leg 23 is thus flared towards its lower end. The inner leg 24 is interconnected with the closure portion 8 by a circular raised region 26.

Figure 3:
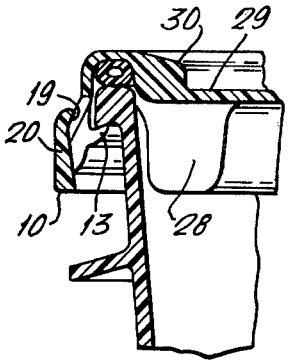
FIGS. 3, 4, 5 and 6 are, respectively, cross-sectional views on an enlarged scale taken along lines III—III, IV—IV, V—V and VI—VI in FIG. 2.
Figure 6:
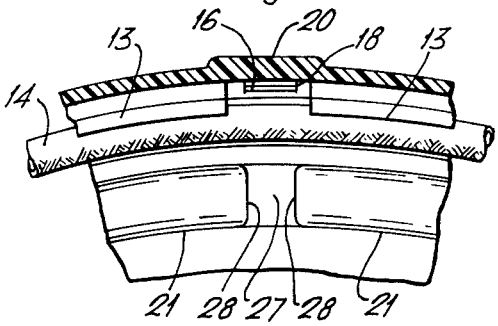

The sections 21 of the reinforcement 22 are equal in number to the sections 13 of the locking bead and are spaced apart by gaps 27 (FIG. 6). These gaps are defined by opposing end walls 28 of adjacent sections 21 and by radial extensions 29 of the raised regions 26 which connect the closure portion 8 in the area of the gaps with the upper end of the leg 23 (FIG. 3). The purpose of the gaps will become apparent during the discussion below. For ease and convenience of manufacture, the gaps are radially aligned, one with each recess 18 and the width of each gap 27 is substantially equal to the circumferential width of each recess. This allows for simplification in the manufacture of mold parts for forming the gaps 27 and the configuration of the recesses 18 and holes 16.

In line with the radial centerline of each gap 27 is a rib 30 of short radial length which extends upwardly from the associated extension 29 of regions 26 and radially inwards from the upper end of the leg 23. The ribs have a thickness slightly less than the width of gaps 28 and serve to locate closures in a neat fashion when stacked with the protrusions 20 of the stacked containers directly below one another by registration of the ribs within the gaps 28.

Figure 4:
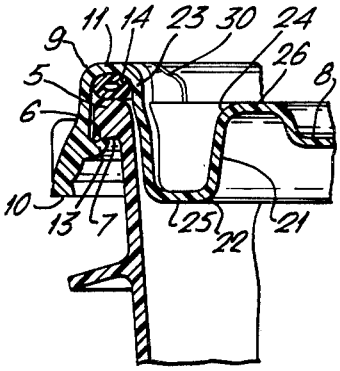
Figure 2:
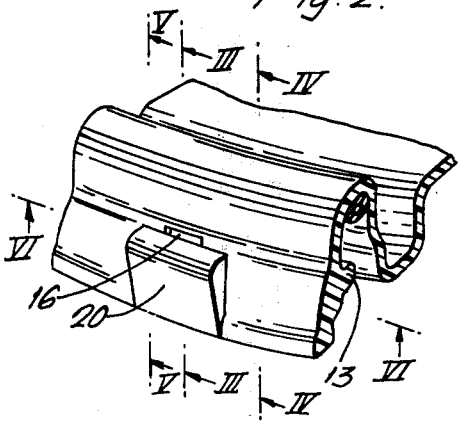
FIG. 2 is an isometric view of part of the closure of FIG. 1.

In use of the closure, it is fitted onto the container with the bead sections 13 locked beneath bead 6 as shown in FIGS. 3, 4 and 5. The flared nature of the flange 9 and leg 23 provides a wide opening between flange and leg for acceptance of rim 5 and the rim is easily led into the opening by machinery designed for assembling the components together. The gaps 27 allow for escape of air from inside of the container and prevent pressurization of the container in the event that the upper end of leg 23 provides a substantial seal with the sidewall 4 during fitting of the closure and before the container is sealed by seal 14. Air is vented during the closure operation through the gaps 27, under the seal 14 and either through holes 16 or between the flange 9 and the sidewall 4. In the assembled condition, spaces 31 (FIG. 3) are formed between flange 9 and the bead 6 in positions between bead sections 13, with the recesses 18 widening the spaces at their mid-circumferential positions.

Figure 7:
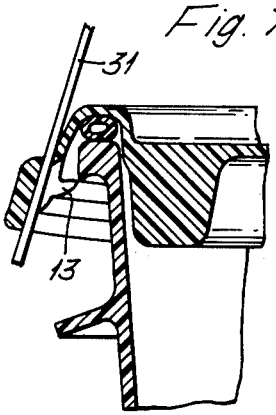
FIG. 7 is a view similar to FIG. 3 showing the action of a closure removal tool upon the closure.

When it is required to remove the closure, a thin rod-type rigid removal tool 31, such as a screw-driver blade, is inserted downwardly through a hole 16 (FIG. 7), and the tool passes along the recess 18 so as to be disposed with its lower end lying either between adjacent bead sections 13 or lower and possibly even beyond the free end 10 of the flange as shown in FIG. 7. The top end of the tool is then urged towards the center of the closure, shown by the top arrow in FIG. 7, so that the base of the flange acts as a fulcrum point, and a lower end or part of the tool exerts a prising force upon the flange at a point of application between the circumferential line of the locking bead and the free end of the flange to urge the flange outwards (lower arrow in FIG. 7). The protrusion at that position is rigid so that local circumferential bending of the rim flange in the vicinity of the access region does not result or is negligible. Instead, because of the circumferential stiffness of the protrusion, the outward force applied by the tool is transmitted to the parts of the flange disposed circumferentially at the sides of the protrusion and from there to the adjacent parts of the flanking bead sections 13. The result is that the adjacent parts of the bead sections are flexed and moved away from beneath the bead 6 of the container to unlock that particular part of the closure. This situation is shown by FIG. 7. This procedure is then followed at a next adjacent access region which will result in complete unlatching of one of the bead sections 13 which was partially unlatched by operation upon the access region just described, and also in partial unlatching of the next adjacent bead section. The procedure is then followed progressively around the closure at other access regions until sufficient bead sections have been unlatched to enable the closure to be completely removed.

During flexing of bead sections 13, closure removal is also assisted by the discontinuous nature of the reinforcement 22. The gaps 28 allow for individual flexing of adjacent sections 21 of the reinforcement by opening of the gaps thus permitting the base 11 to be flexed in the opening direction after slight opening movement of the closure has occurred. At this point, a section 21 may already have been dislodged slightly from within the container and flexing of this section by operation of the removal tool within a hole 16 moves the lower end of the leg 23 towards the container sidewall and lessens resistance of the closure to unlatching of the bead sections 13.

As can be seen from the above described embodiment, no splitting of the rim flange can result such as would be the case if the removal tool were inserted through a hole and operated in prising manner where the flange section was weakened between bead sections 13 and not provided with any additional reinforcement. Apart from preventing splitting, each protrusion has a stiffening effect which resists bending circumferentially and thus transmits the prising force to the nearby bead sections 13 to cause their unlatching from the bead 6. Thus, it can be seen that with this large size closure, no damage results during its removal so that it may be replaced while having as an efficient seal and the same locking effect with its container which it had when initially fitted. Also because of the position of holes 16 and the locking bead together with the spacing apart of the bead sections 13 beneath the holes 16, the point of application of the tool may be chosen to be lower than the locking bead whereby mechanical advantage upon levering is obtainable because of maximizing the distance between the fulcrum position of point of application for the prising force of the tool. Further, with the point of application being located thus, the bead sections are moved outwards without placing undue strain at the top of the flange so that there is little or no chance of distorting the flange base 11 beyond its elastic limit. Hence, the flange will return resiliently to its former position after closure removal thereby allowing for the closure to be refitted to the same or another container with the locking bead still acting effectively.

Figure 8:
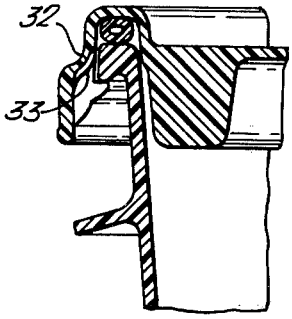
FIG. 8 is a view similar to FIG. 7 of a modification to the first embodiment.

In a modification of the first embodiment shown in FIG. 8, each access region comprises a membrane or web 32 extending across a hole 33. To remove the closure, it is necessary to break the web with the tool. While the closure may then be refitted with its sealing and locking action unimpaired, the closure is "tamperproof" in the sense that broken webs at the access regions indicate to a second user that access has previously been gained to the container contents.

Figure 9:
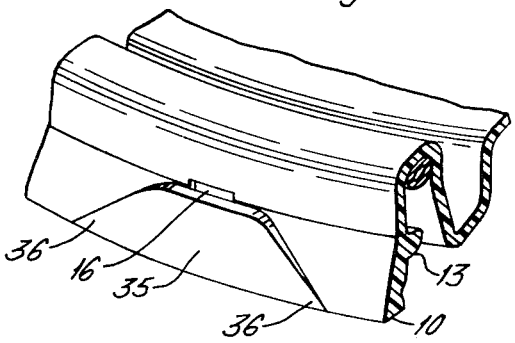
FIG. 9 is a view similar to FIG. 2 of a second embodiment.

In a second embodiment shown in FIG. 9, a closure 34 is of construction basically similar to that of the first embodiment and parts of similar construction bear the same reference numerals. In this embodiment, the difference from the first embodiment is the shape of protrusions 35 at each access region. As can be seen, each protrusion 35 tapers from top to bottom as in the first embodiment but also extends circumferentially around the rim flange from its access region and tapers at each side towards the free end 10 of the flange. Each side 36 of each protrusion overlaps circumferentially, end portions of an adjacent bead section 13 so as to increase the stiffness of the flange in the access region and in immediately adjacent regions and also to assist in transmitting the prising force into the bead sections 13.

In the second embodiment, a modification (not shown) may be employed such as is described in the first embodiment, i.e. in which webs of plastic extend across holes in the access regions which it is necessary to break before the closure may be removed. These closures are then rendered "tamperproof" in the sense referred to in the first embodiment.

What is claimed is:

1. A closure for a container comprising:

(a) a cover portion; and (b) a continuous rim flange extending around the cover portion;

(c) the rim flange extending downwardly from a base end to a free end and having:

(i) a circumferentially discontinuous and radially inwardly projecting locking bead for locking engagement with a container;

(ii) a plurality of circumferentially spaced-apart access regions disposed between the base end of the flange and the locking bead and in circumferential positions between adjacent discontinuous sections of the locking bead to enable a closure removal tool to be inserted downwardly through each access region and between adjacent discontinuous sections of the bead; and (iii) a plurality of rim stiffening protrusions which project from the outer surface of the flange in at least said circumferential positions between the discontinuous sections of the bead and which overlie the circumferential line of the locking bead to resist bending of the flange circumferentially in said circumferential positions upon prising of the free end of the rim flange radially outwards by the closure removal tool inserted downwardly through the access regions and to assist bending outwards of the flange circumferentially at each side of said access regions to promote radial outward movement of the locking bead.

2. A closure according to claim 1 wherein each access region comprises a hole through the flange for insertion of the removal tool.

3. A closure according to claim 1 wherein in each access there is a web of flange material thinner than surrounding areas of flange, said web being breakable to enable the tool to pass through it.

4. A closure according to claim 1 wherein each stiffening protrusion extends downwardly from its access region towards the free end of the flange.

5. A closure according to claim 1 wherein each protrusion extends circumferentially at least the distance between ends of adjacent locking bead sections.

6. A closure according to claim 5 wherein the locking bead is spaced upwardly from the free end of the flange and each protrusion extends from the circumferential line of the locking bead towards the free end of the flange.

7. A closure according to claim 5 wherein each protrusion is of rectangular shape and extends circumferentially from its access region at least as far as the near ends of the adjacent discontinuous bead sections.

8. A closure according to claim 1 wherein a reinforcement extends around the cover portion and lies within and is spaced from the rim flange so as to provide a gap for acceptance of the rim of a container, and the reinforcement is formed of discontinuous and circumferentially spaced arcuate sections.

9. A closure according to claim 8 wherein the sections of the reinforcement are spaced-apart by gaps which are radially in alignment one with each of the access regions of the rim flange.

10. A container and closure assembly comprising:

(A) a container having a sidewall, a lip at an opening to the container, and a radially outwardly projecting bead; and (B) a closure comprising:

(a) a cover portion extending across the opening to the container; and (b) a continuous rim flange extending around the cover portion and down around the lip and bead of the container, the rim flange extending downwardly from a base end to a free end and having:

(i) a circumferentially discontinuous and radially inwardly projecting locking bead in locking engagement beneath the bead of the container, the flange and the bead of the container defining a space between them in circumferential positions between adjacent discontinuous sections of the locking bead;

(ii) a plurality of circumferentially spaced-apart access regions disposed between the base end of the flange and the locking bead and in said circumferential positions to enable a closure removal tool to be inserted downwardly through each access region and through said space between the sidewall and the bead of the container; and (iii) a plurality of rim stiffening protrusions which project from the outer surface of the flange in at least said circumferential positions between the discontinuous sections of the bead and which overlie the circumferential line of the locking bead to resist bending of the flange circumferentially in said circumferential positions upon prising of the free end of the rim flange radially outwards by the closure removal tool inserted downwards through the access regions and through said spaces, and to assist bending outwards of the flange circumferentially at each side of said access regions to promote radial outward movement of the locking bead.

* * * * *